US006181230B1

(12) United States Patent
Broome et al.

(10) Patent No.: US 6,181,230 B1
(45) Date of Patent: Jan. 30, 2001

(54) VOLTAGE COIL AND METHOD AND MAKING SAME

(75) Inventors: Russell C. Broome, Garner; Ronald E. Privette, Youngsville; Roger D. Stephenson, Raleigh, all of NC (US)

(73) Assignee: ABB Power T&D Company Inc., Raleigh, NC (US)

( * ) Notice: Under 35 U.S.C. 154(b), the term of this patent shall be extended for 0 days.

(21) Appl. No.: 09/158,012

(22) Filed: Sep. 21, 1998

(51) Int. Cl.[7] ..... H01F 27/30
(52) U.S. Cl. ..... 336/198; 336/192; 336/208
(58) Field of Search ..... 336/192, 198, 336/208; 29/602.1, 603.23, 603.24, 603.25

(56) References Cited

U.S. PATENT DOCUMENTS

| | | | | |
|---|---|---|---|---|
| 3,117,294 | * | 1/1964 | Muszynski et al. | 336/192 |
| 3,230,489 | * | 1/1966 | Weyrich | 336/192 |
| 3,230,490 | * | 1/1966 | Johnson | 336/192 |
| 3,461,413 | * | 8/1969 | Randolph et al. | 336/192 |
| 3,675,175 | | 7/1972 | Dutton | 336/70 |
| 3,716,038 | | 2/1973 | Bevacqua | 123/148 A |
| 4,156,888 | | 5/1979 | Takahashi | 361/331 |
| 4,166,265 | * | 8/1979 | Reynolds et al. | 336/192 |
| 4,246,636 | | 1/1981 | Kawamura et al. | 363/146 |
| 4,414,578 | | 11/1983 | Takeichi | 358/243 |
| 4,701,735 | | 10/1987 | Hill et al. | 335/282 |
| 4,765,861 | | 8/1988 | Curtis, Jr. et al. | 156/457 |
| 4,896,839 | | 1/1990 | Curtis, Jr. et al. | 242/7.02 |
| 4,901,773 | | 2/1990 | Marshall et al. | 140/92.1 |
| 5,028,905 | | 7/1991 | Lostumo | 336/205 |
| 5,036,580 | | 8/1991 | Fox et al. | 29/605 |
| 5,565,833 | | 10/1996 | Leet et al. | 335/250 |
| 5,699,977 | | 12/1997 | Watanabe | 242/439 |
| 5,774,036 | | 6/1998 | Hrytzak et al. | 336/192 |

OTHER PUBLICATIONS

AMP Magnet Wire Terminals (AMPLIVAR and MAG–MATE), Catalog 82221, Revised Apr., 1995, 34–36.
Design in Japan, "Nylon coil survives lightning–like surges", *Design News*, Jul. 20, 1998, 1 page.
DuPont® Engineering Polymers, "Electrical/Electronic Thermoplastic Encapsulation", Jul., 1996, 1–19.
DuPont® Zytel nylon resin, "Encapsulated Coil Delivers Cost Savings, Super High–Voltage Performance", Apr., 1998, 1 page.

* cited by examiner

*Primary Examiner*—Michael L. Gellner
*Assistant Examiner*—Anh Mai
(74) *Attorney, Agent, or Firm*—Woodcock Washburn Kurtz Mackiewicz & Norris LLP

(57) ABSTRACT

A coil for use in the voltage section of the electromagnet in electromechanical utility watthour meters comprises a thermoplastic bobbin, a length of wire, and two terminals. The bobbin has an upper flange and a lower flange connected by a central, hollow core. The upper flange supports two terminal mounting boxes in which terminals are inserted. The first and second leads (i.e., wire ends) are electrically and mechanically isolated from each other in order for the coil to withstand high voltage power surges. The upper flange also supports a step that has a recessed, side profile that guides the path of the wire to the core without introducing sharp bends or turns into the wire. Excess length of the first and second ends of the wire length are secured to tie off posts that are located on the top of the terminal mounting boxes. These posts, along with the excess wire, are removed when the terminals are inserted into the mounting boxes.

13 Claims, 4 Drawing Sheets

VOLTAGE COIL AND METHOD AND MAKING SAME

FIELD OF THE INVENTION

The present invention relates in general to electromechanical utility watthour meters. More particularly, the present invention relates to voltage coils for use in such meters.

BACKGROUND OF THE INVENTION

A voltage coil is an essential component in the electromagnet section of an electromechanical utility watthour meter. Voltage coils typically comprise three primary elements: a bobbin composed of an electrically inert material, wire capable of generating a magnetic field, and isolated terminal or wire ends. A voltage coil is also encapsulated prior to final testing. The manufacture of conventional voltage coils is labor intensive and these voltage coils are typically not able to handle large voltages; e.g., those on the order of about 8,000 volts.

FIG. 1A shows a top view of a conventional voltage coil. FIG. 1B shows a bottom view (without attached terminals) and FIG. 1C shows a side cross-sectional view of the conventional voltage coil of FIG. 1A. In manufacturing a conventional voltage coil, one end of a wire 5, such as copper, is captured in a terminal, then an operator inserts a terminal 10 into a first or start terminal mounting box 15 that is part of a bobbin 2. The wire 5 is guided around the box 15 and through a slot 17 in an upper flange 20 and wrapped around the core 25 of the bobbin 2 a predetermined number of times or windings. It should be noted that the bobbin 2 also comprises a lower flange 22, and the wire 5 is wound around the core 25 between the upper flange 20 and the lower flange 22.

After the wire has been wound the predetermined number of windings, a piece of tape is applied to keep the wire from unwinding. The wire is again captured in a second or end terminal 30 and the end terminal 30 is then inserted into a second or end terminal mounting box 35. In FIG. 1A, the wire 5 is shown as a dashed line toward its starting and ending points. The voltage coil is then sent for the subsequent steps of testing and encapsulation. The winding of the conventional voltage coil is labor intensive, and has a long manufacture cycle which leads to low productivity and high cost. Also, the encapsulation of the conventional voltage material uses a thermoset material which leads to a long cure time, poor yield, low productivity, and high cost.

U.S. Pat. No. 5,774,036, entitled "Bobbin-Mounted Solenoid Coil and Method of Making", issued to Hrytzak et al., describes a solenoid coil in which a magnet wire (MW) is wrapped around a bobbin core (24) and terminals (84, 86) are inserted into terminal sockets to connect to the magnet wire (MW). The solenoid coil is used in very low voltage applications, such as those in automotive vehicles (about 12 volts), and cannot be used in high voltage or electromagnet applications because the terminals are spaced too close together, thus resulting in the starting and ending points of the wire being close together. It should be noted that a solenoid is different from an electromagnet.

Although the art of voltage coils is well developed, there remain some problems inherent in this technology, particularly the ability for small coils having very fine magnet wire to handle high voltages. Therefore, a need exists for a voltage coil that overcomes the drawbacks of the prior art.

SUMMARY OF THE INVENTION

The present invention is directed to a coil for high voltage applications, comprising a bobbin comprising a core, an upper flange having a grooved step channel and a slot extending from the grooved step channel to the core, a lower flange, and a first terminal mounting box and a second terminal mounting box disposed on the upper flange; a wire wound around the core of the bobbin in a predetermined number of turns and having a first end disposed in the first terminal mounting box and a second end disposed in the second terminal mounting box; a first terminal positioned in the first terminal mounting box to secure the first end of the wire; and a second terminal positioned in the second terminal mounting box to secure the second end of the wire.

According to further aspects of the invention, the bobbin is made of a thermoplastic material, the wire comprises an insulated magnet wire, and the core is hollow, has a square cross-section, and is centrally disposed between the upper flange and the lower flange.

According to one aspect of the present invention, the first and second terminal mounting boxes are spaced apart sufficient to mechanically and electrically isolate the first and second ends of the wire. Preferably, the upper flange has a circumference and the first and second terminal mounting boxes are located at approximately one-quarter of the circumference.

In accordance with another aspect of the present invention, the first and second terminals comprise a plurality of serrations that contact the first and second ends of the wire, respectively. Moreover, the first terminal mounting box has a first lower slot and the first end of the wire extends from the first terminal through the first lower slot to the core, and the second terminal mounting box has a second lower slot and the second end of the wire extends from the core through the second slot to the second terminal.

In accordance with a further aspect of the present invention, the first end of the wire extends from the first terminal through the first lower slot, around and within the grooved step channel of the upper flange through the slot, to the core. Moreover, the grooved step channel comprises radial edges to minimize bends in the wire.

In a further embodiment within the scope of the present invention, a bobbin for use in a voltage coil section of an electromagnet is provided that comprises a core; a stepped upper flange having a grooved step channel and a slot extending from the grooved step channel to the core; a lower flange; and a first terminal mounting box and a second terminal mounting box disposed on the upper flange, wherein the core extends between the upper flange and the lower flange.

In accordance with a further aspect of the present invention, the bobbin further comprises a removable first tie off post disposed on the first terminal mounting box and a removable second tie off post disposed on the second terminal mounting box. The first and second tie off posts are used for securing a wire. Preferably, the first terminal mounting box has a first lower slot and a first upper slot, and the second terminal mounting box has a second lower slot and a second upper slot, and the slots are used for guiding the wire from the first and second tie off posts to the core.

Another embodiment within the scope of this invention includes a method for making a voltage coil comprising the steps of providing a bobbin that comprises a core, a stepped upper flange having a grooved step channel and a slot extending from the grooved step channel to the core, a lower flange, wherein the core extends between the upper flange and the lower flange, a first terminal mounting box and a second terminal mounting box disposed on the upper flange, the first terminal mounting box having a first lower slot and a first upper slot, and the second terminal mounting box having a second lower slot and a second upper slot, and a removable first tie off post disposed on the first terminal mounting box and a removable second tie off post disposed on the second terminal mounting box; providing a length of wire; securing a first end of the wire to the first tie off post; running the wire in tension from the first tie off post through the first upper slot and the first lower slot, along and within the grooved step channel of the upper flange through the slot, to the core; winding the wire a predetermined number of times around the core; running the wire in tension from the core through the second lower slot and the second upper slot to the second tie off post; securing a second end of the wire to the second tie off post; and mounting a first terminal in the first terminal mounting box and a second terminal in the second terminal mounting box to establish electric connection or conductivity between the tensioned wire and the respective terminal.

According to another aspect of the present invention, the method further comprises the steps of terminating the first and second ends of the wire that are attached to the first and second tie off posts, and removing the first and second ends of the wire and the first and second tie off posts.

BRIEF DESCRIPTION OF THE DRAWINGS

The foregoing and other aspects of the present invention will become apparent from the following detailed description of the invention when considered in conjunction with the accompanying drawings. For the purpose of illustrating the invention, there is shown in the drawings an embodiment that is presently preferred, it being understood, however, that the invention is not limited to the specific methods and instrumentalities disclosed. In the drawings.

DESCRIPTION OF EXEMPLARY EMBODIMENTS AND BEST MODE

Figure 1A:
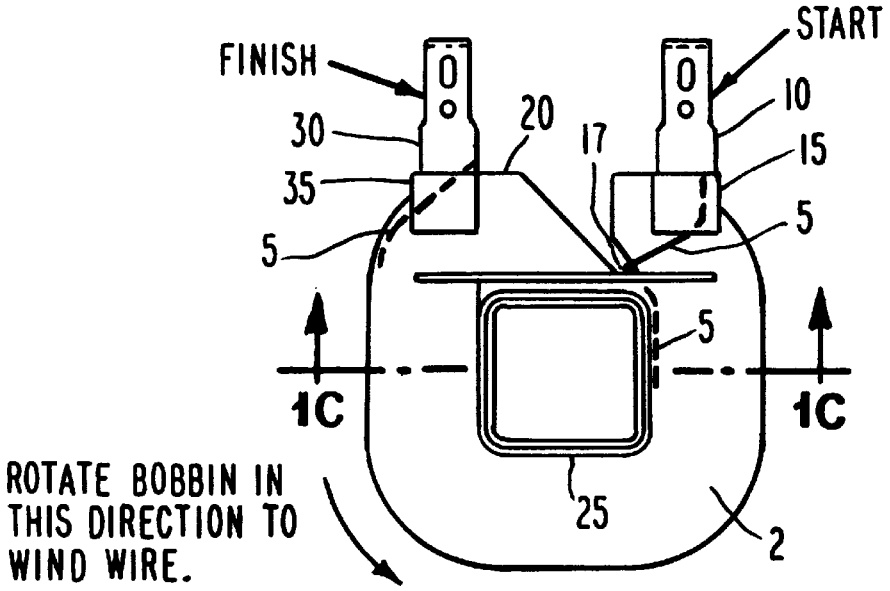
PRIOR ART Fig. 1A
FIG. 1A illustrates a top view of the prior art voltage coil.
Figure 1B:
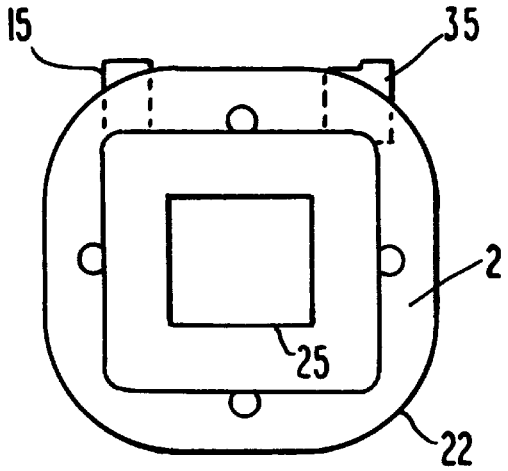
PRIOR ART Fig. 1B
FIG. 1B illustrates a bottom view of the prior art voltage coil.
Figure 1C:
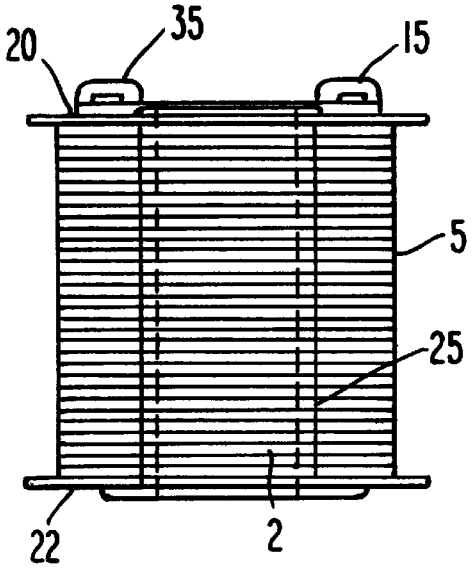
PRIOR ART Fig. 1C
FIG. 1C illustrates a side cross-sectional view of the voltage coil taken along line 1C—1C of FIG. 1A.
Figure 2:
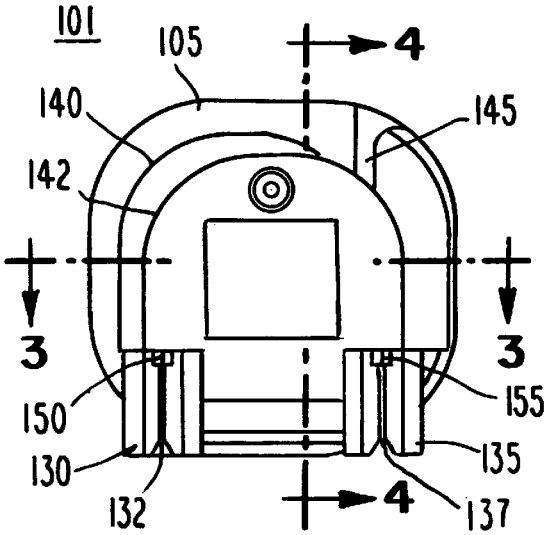
FIG. 2 illustrates a top view of an exemplary bobbin for use in a voltage coil in accordance with the present invention.
Figure 3:
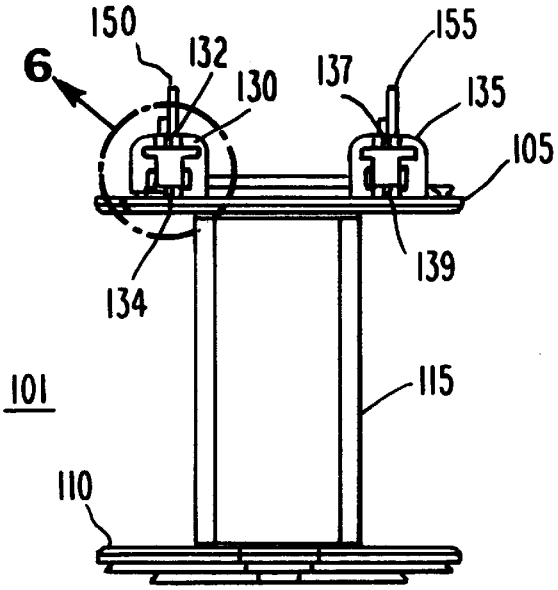
FIG. 3 illustrates a side cross-sectional view of the bobbin of FIG. 2 taken along line 3—3 of FIG. 2.
Figure 4:
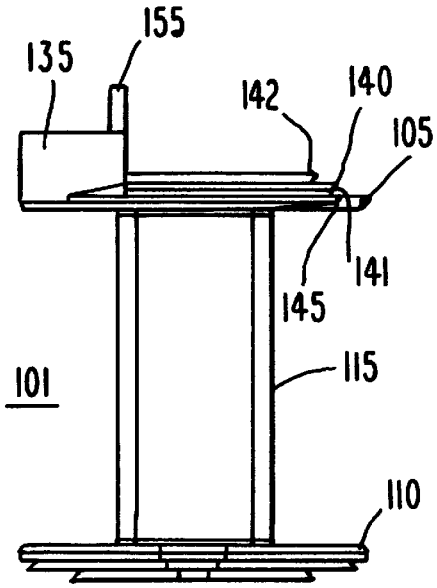
FIG. 4 illustrates a side cross-sectional view of the bobbin of FIG. 2 taken along line 4—4 of FIG. 2.

FIG. 2 is a top view of an exemplary bobbin for use in a voltage coil section in an electromagnet in accordance with the present invention, FIG. 3 illustrates a side cross-sectional view of the bobbin of FIG. 2 taken along line 3—3 of FIG. 2, and FIG. 4 is a side cross-sectional view of the bobbin of FIG. 2 taken along line 4—4 of FIG. 2. The bobbin 101 comprises an upper flange 105, a lower flange 110, and a core 115. The core 115 connects the upper flange 105 and the lower flange 110.

Figure 5:
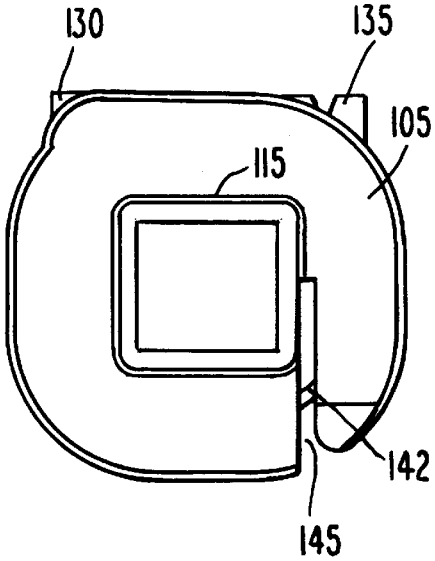
FIG. 5 illustrates a bottom view of the upper flange of the bobbin of FIG. 2.

The upper flange 105 supports a pair of terminal mounting boxes 130, 135 which each have an opening to receive a terminal. Preferably, the terminal mounting boxes 130, 135 are located at approximately one-quarter of the circumference of upper flange 105. One or more steps or channels are disposed on the upper flange 105. In a preferred embodiment, there are two steps 140, 142, as shown in the figures. FIG. 5 illustrates a bottom view of the upper flange 105 of the bobbin 101 of FIG. 2. The upper flange 105 has a notch or slot 145 that runs from the outer edge of the flange 105 to the core 115.

The bobbin 101 preferably comprises a thermoplastic material, for example, Zytel® 70G33HS1L, manufactured by Dupont, which is a 33% glass filled, heat stabilized nylon 6/6. This material has less fiberglass filler than the thermoplastic material used in conventional bobbins and extends the life of tooling and processing equipment, thereby providing a better quality voltage coil possessing higher repeatability and shorter cycle times in manufacturing. The material also eliminates secondary deflashing operations. Preferably, the core 115 is hollow, centered, and square shaped, although any shape core can be used.

Removable or disposable tie off posts 150, 155 are disposed on the terminal mounting boxes 130, 135, respectively. The tie off posts 150, 155 can be used to provide tension to the wire during and after winding and before the terminals are installed. The tie off posts can also be used in the positioning of the wire, which are provided during the subsequent manufacture of the voltage coil. As described further below, the start or first end of the wire is wrapped around the tie off post 150 prior to the wire being wound around the core 115, and the finish or second end of the wire is wrapped around the tie off post 155 at the completion of the wire being wound around the core. The tie off posts 150, 155 are removed after, or at approximately the same time, the terminals are inserted into the terminal mounting boxes 130, 135. Although posts are shown and described as the preferred embodiment, it is understood that any wire securement means can be used, such as a hook or flange.

Figure 6:
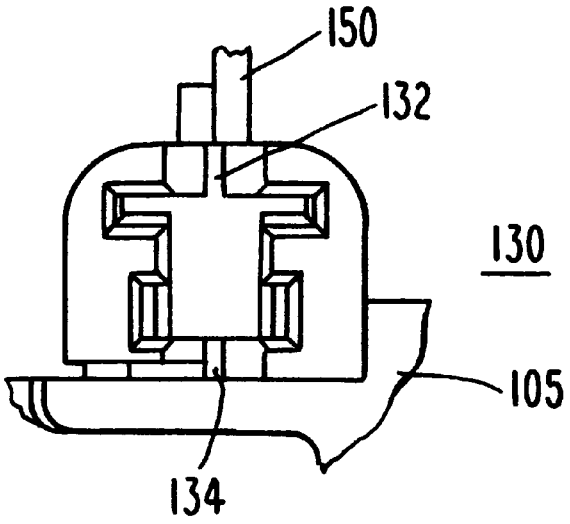
FIG. 6 illustrates an enlarged view of one of the terminal mounting boxes of FIG. 3.

FIG. 6 illustrates an enlarged cross-sectional view of one of the terminal mounting boxes of FIG. 3. Each terminal mounting box has a slot on the top surface and the bottom surface. The terminal mounting box 130 has a slot 132 on the top surface and a slot 134 on the bottom surface, and the terminal mounting box 135 has a slot 137 on the top surface and a slot 139 on the bottom surface. As described in further detail below, the slots 132, 134 of the terminal mounting box 130 allow the first end of the wire to be attached to the tie off post 150 and gradually wound around the grooved step 140 on the upper flange 105 of the bobbin 101 prior to being wound around the core 115. Thus, the terminal mounting box 130 routes the wire from the tie off post 150 to the core 115 of the bobbin 101. The slots 137, 139 of the second terminal mounting box 135 allow the second end of the wire to pass from the core 115 to the tie off post 155 after the winding is completed. Thus, the terminal mounting box 135 routes the wire from the last winding on the core to a tie off post 155.

The terminal mounting box 130 isolates the starting portion of the wire from the windings around the core 115. The terminal mounting box 135 keeps the ending portion of the wire isolated from the windings around the core 115. The terminal boxes 130 and 135 are spaced a sufficient distance apart so that the terminals 180 and 185, and their associated ending portions of the wire, remain electrically and mechanically isolated, even for very high voltages, such as about 8,000 volts.

Figure 7:
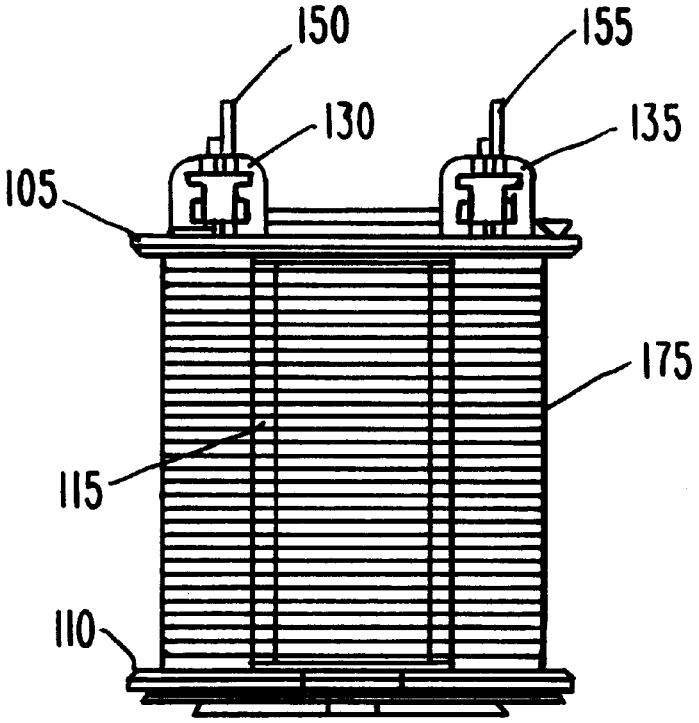
FIG. 7 illustrates a side cross-sectional view of an exemplary voltage coil in accordance with the present invention.

FIG. 7 illustrates a cross-sectional view of an exemplary voltage coil in accordance with the present invention, before terminals are added to the terminal mounting boxes 130, 135 and the tie off posts 150, 155 have been removed. A magnet wire 175, such as insulated copper wire, is wound around the bobbin core 115 a predetermined number of times or windings, between the upper flange 105 and the lower flange 110. After the wire 175 is wound, terminals 180, 185 are inserted into the terminal mounting boxes 130, 135, respectively. The insertion of the terminals 180, 185 into the boxes 130, 135 penetrates or crimps the wire 175 at the ends near the tie off posts 150, 155. The wire between the terminal 180 and the tie off post 150 is removed, as is the wire between the terminal 185 and the tie off post 155, along with the tie off posts 150, 155 because they no longer provide tension to the wire 175. The termination of the wire ends is preferably performed via automation.

Figure 8:
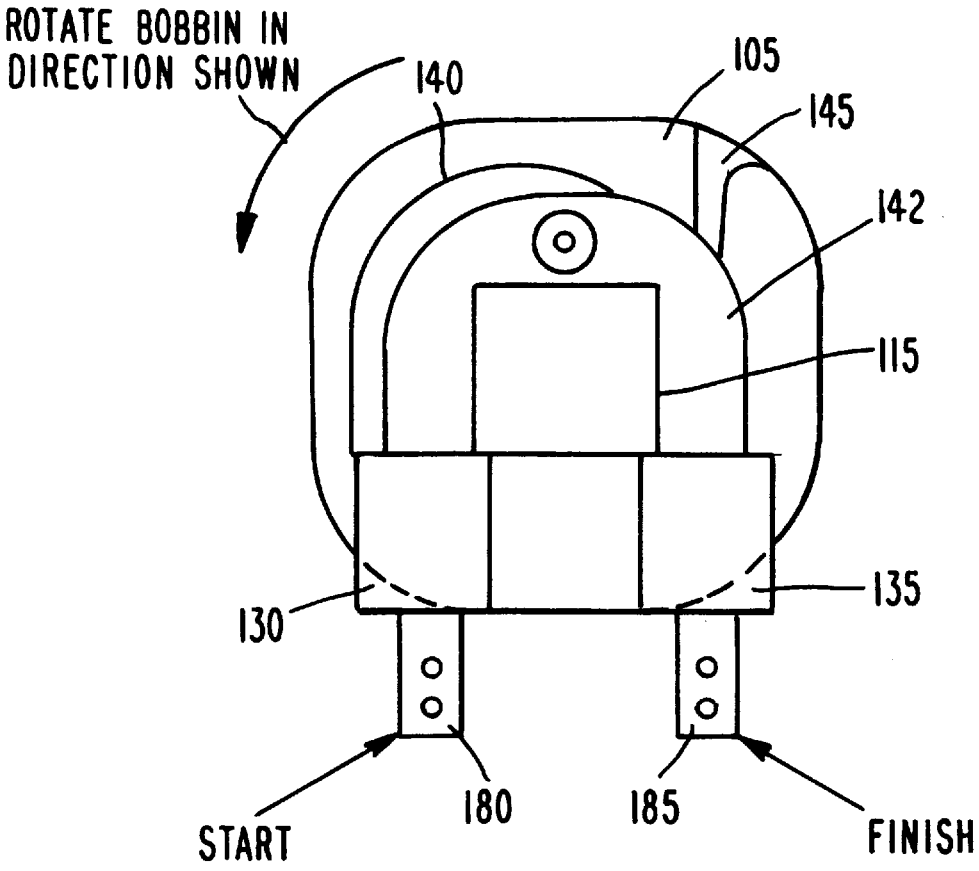
FIG. 8 illustrates a top view of an exemplary voltage coil in accordance with the present invention.
Figure 9A:
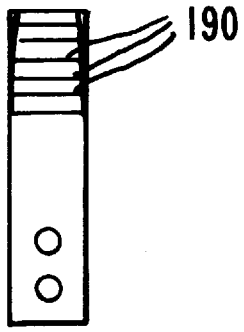
FIGS. 9A and 9B show a top view and a side view, respectively, of an exemplary serrated terminal in accordance with the present invention.
Figure 9B:
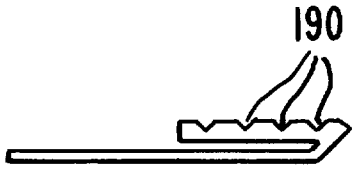

FIG. 8 illustrates a top view of an exemplary voltage coil in accordance with the present invention. In FIG. 8, the terminals 180, 185 have been inserted into the terminal mounting boxes 130, 135 and the tie off posts have been removed. Although any terminal can be used, it is desirable that the end of each terminal that is inserted into the terminal mounting box has serrations 190, as shown in FIGS. 9A and 9B, which show a top view and a side view, respectively, of an exemplary serrated terminal in accordance with the present invention. The terminal, in its preferred embodiment, possesses a plurality of serrations 190 on its underside that crimp and terminate the start and finish ends of the wire 175 (e.g., a mini MAG-MATE terminal, manufactured by AMP, Inc.).

An exemplary voltage coil, for use in an electromagnet, in accordance with the present invention is fabricated by attaching a first end of the wire 175 to the tie off post 150. The wire 175 is then passed through upper slot 132 and lower slot 134, and then is routed along the perimeter of step 140. The step 140 preferably has a grooved recess 141 that provides a guided and secured path for the wire 175. The wire 175 is then passed through the notch or slot 145 to the core 115. The wire 175 is wound around the core 115 a predetermined number of times or windings, preferably by an automated winding machine. After the wire 175 has been wound, the end of the wire is passed through the lower slot 139 and the upper slot 137 of the terminal box 135. The end of the wire is then secured to the tie off post 155. By securing the two ends of the wire 175 to the tie off posts 150, 155, the wire 175 is provided with tension. The terminals 180, 185 are inserted into terminal mounting boxes 130, 135, respectively. The terminals 180, 185 crimp the ends of the wire. The tie off posts 150, 155 are removed, along with the excess wire between the tie off posts and the point of terminal penetration or crimping, either during the penetrating or shortly thereafter. The wound bobbin is ready for the subsequent steps of encapsulation and high voltage test. An encapsulating layer (not shown) preferably comprises a thermoplastic material such as Zytel®, as described above.

As described, in a preferred embodiment, the bobbin in accordance with the present invention is used for automated fabrication of a voltage coil section of an electromagnet. The wire is wound to a predetermined number of turns at a predetermined tension. An exemplary table showing magnet wire diameter, number of windings, resistance range, and tension is shown in Table 1.

TABLE 1

Examples of Number of Windings per Wire Diameter

| Diameter of Magnet Wire (inches) | Number of Windings around Bobbin | Resistance Range (ohms) | Tension (+/−5 gr) |
|---|---|---|---|
| .0035 | 16800 | 3260–3280 | 50 |
| .0052 | 9500 | 805–905 | 120 |
| .0056 | 7000 | 510–570 | 125 |
| .0056 | 8400 | 620–720 | 125 |
| .0071 | 4200 | 175–235 | 150 |

Electrical and mechanical isolation of the first and second ends of the terminated wire is accomplished by the location of the terminal mounting boxes 130, 135 and the path of the wire 175. The terminal mounting boxes 130, 135 are preferably set at a distance which is approximately one-quarter the circumference of the upper flange 105. Second, the path of the first wire end is guided along the step 140, which has a grooved side profile 141, on the upper flange 105 to prevent interference with the second end. The wire is guided through the notch or slot 145, preferably located on the opposite end of the upper flange 105, to the core 115. Thus, the start wire is concealed from the rest of the coil for optimum isolation which is desirable for high voltage applications to avoid failure. The guided path of the first end of the wire also reduces surge failures because a primary opportunity for failure is the critical area between the start lead and the rest of the coil where the outermost layer is technically the second end. The guided path also eliminates the stress-inducing sharp turns encountered by the first end in the conventional voltage coils, yet still allows the coil to meet rigid, high voltage test criteria. In addition, the bobbin flange material is of sufficient thickness (preferably about 0.050 inches) and dielectric properties to provide extra insulation in the critical area. Moreover, the magnet wire itself is preferably laminated to provide additional insulation between the turns and layers.

Thus, the voltage coil in accordance with the present invention provides a more efficient, less labor-intensive, and higher yield device that can be made by an automated manufacturing process, thereby decreasing the cost of the voltage coil. Furthermore, the voltage coil is capable of handling high voltage, on the order of about 8,000 volts.

Although illustrated and described herein with reference to certain specific embodiments, it will be understood by those skilled in the art that the invention is not limited to the embodiments specifically disclosed herein. Those skilled in the art also will appreciate that many other variations of the specific embodiments described herein are intended to be within the scope of the invention as defined by the following claims.

What is claimed:

1. A coil for high voltage applications, comprising:

a bobbin comprising a core, a stepped upper flange having a grooved step channel and a slot extending from said grooved step channel to said core, a lower flange, and a first terminal mounting box and a second terminal mounting box disposed on said upper flange, said first and second terminal mounting boxes having a first and a second lower slot, respectively;

a wire wound around said core of said bobbin in a predetermined number of turns and having a first end disposed in said first terminal mounting box and a second end disposed in said second terminal mounting box;

a first terminal positioned in said first terminal mounting box to secure said first end of said wire; and a second terminal positioned in said second terminal mounting box to secure said second end of said wire, wherein said first end of said wire extends from said first terminal through said first lower slot to said core around and within said grooved step channel of said upper flange through said slot to said core, and said second end of said wire extends from said core through said second slot to said second terminal.

2. The coil of claim 1, wherein said bobbin comprises a thermoplastic material, said wire comprises an insulated magnet wire, and said core is hollow, has a square cross-section, and is centrally disposed between said upper flange and said lower flange.

3. The coil of claim 1, wherein said first and second terminal mounting boxes are spaced apart sufficient to mechanically and electrically isolate said first and second ends of said wire.

4. The coil of claim 1, wherein said upper flange has a circumference and said first and second terminal mounting boxes are located at approximately one-quarter of said circumference.

5. The coil of claim 1, wherein said first and second terminals comprise a plurality of serrations that contact said first and second ends of said wire, respectively.

6. The coil of claim 1, wherein said grooved step channel comprises radial edges to minimize bending said wire.

7. A bobbin for use in a voltage coil, comprising:

a core;

a stepped upper flange having a grooved step channel and a slot extending from said grooved step channel to said core;

a lower flange; and a first terminal mounting box and a second terminal mounting box disposed on said upper flange, a removable first tie off post disposed on said first terminal mounting box and a removable second tie off post disposed on said second terminal mounting box, said first and second tie off posts for securing a wire having a first end and a second end, wherein said core extends between said upper flange and said lower flange and wherein said first terminal mounting box has a first lower slot and a first upper slot, and said second terminal mounting box has a second lower slot and a second upper slot, said slots for guiding said wire from said first and second tie off posts to said core and said first end of said wire extends from said removable first tie off post through said first lower slot to said core around and within said grooved step channel of said upper flange through said slot to said core, and said second end of said wire extends from said core through said second slot to said removable second tie off post.

8. The bobbin of claim 7, wherein said bobbin comprises a thermoplastic material, and said core is hollow, has a square cross-section, and is centrally disposed between said upper flange and said lower flange.

9. The bobbin of claim 7, wherein said first and second terminal mounting boxes are spaced apart sufficient to mechanically and electrically isolate a first and second end of a wire.

10. The bobbin of claim 7, wherein said upper flange has a circumference and said first and second terminal mounting boxes are located at approximately one-quarter of said circumference.

11. The bobbin of claim 7, wherein said grooved step channel comprises radial edges.

12. A method of making a voltage coil, comprising:

providing a bobbin that comprises:

a core;

a stepped upper flange having a grooved step channel and a slot extending from said grooved step channel to said core;

a lower flange, wherein said core extends between said upper flange and said lower flange;

a first terminal mounting box and a second terminal mounting box disposed on said upper flange, said first terminal mounting box having a first lower slot and a first upper slot, and said second terminal mounting box having a second lower slot and a second upper slot; and a removable first tie off post disposed on said first terminal mounting box and a removable second tie off post disposed on said second terminal mounting box;

providing a length of wire;

securing a first end of said wire to said first tie off post;

running said wire in tension from said first tie off post through said first upper slot and said first lower slot, along and within said grooved step channel of said upper flange through said slot, to said core;

winding said wire a predetermined number of times around said core;

running said wire in tension from said core through said second lower slot and said second upper slot to said second tie off post;

securing a second end of said wire to said second tie off post; and mounting a first terminal in said first terminal mounting box and a second terminal in said second terminal mounting box to establish electric conductivity between said tensioned wire and said respective terminal.

13. The method of claim 12, further comprising the steps of:

terminating said first and second ends of said wire that are attached to said first and second tie off posts; and removing said first and second ends of said wire and said first and second tie off posts.

* * * * *